US006802110B2

(12) United States Patent
Berweger et al.

(10) Patent No.: US 6,802,110 B2
(45) Date of Patent: Oct. 12, 2004

(54) WEB EXPANDING DEVICE

(75) Inventors: Dominik Berweger, Thun (CH); Beat Luginbühl, Leissigen (CH); Erich Kaufmann, Gunten (CH)

(73) Assignee: Maschinenfabrik Wifag, Bern (CH)

( * ) Notice: Subject to any disclaimer, the term of this patent is extended or adjusted under 35 U.S.C. 154(b) by 0 days.

(21) Appl. No.: 10/629,046

(22) Filed: Jul. 28, 2003

(65) Prior Publication Data

US 2004/0021032 A1 Feb. 5, 2004

(30) Foreign Application Priority Data

Jul. 30, 2002 (DE) ..... 102 34 674

(51) Int. Cl.[7] ..... D06C 3/00
(52) U.S. Cl. ..... 26/71; 26/87; 28/170
(58) Field of Search ..... 26/71, 99, 101, 26/102, 103, 7, 72, 73, 82, 87, 97, 51.3, 51; 28/170; 83/175, 425, 435, 436.4, 436.6, 443, 448, 449; 264/280, 288.4, 289.3; 271/184, 314, 302, 303, 305; 242/615, 615.1, 615.2, 615.21; 226/15, 17, 21, 24, 34

(56) References Cited

U.S. PATENT DOCUMENTS

| | | | | | |
|---|---|---|---|---|---|
| 844,316 | A | * | 2/1907 | Birch | 26/102 |
| 992,703 | A | * | 5/1911 | Birch | 26/102 |
| 1,748,275 | A | * | 2/1930 | Birch | 26/75 |
| 1,927,849 | A | * | 9/1933 | Roberts | 26/77 |
| 2,198,656 | A | * | 4/1940 | Cohn et al. | 226/23 |
| 2,496,312 | A | * | 2/1950 | Robertson | 26/51.5 |
| 3,161,563 | A | * | 12/1964 | Walker et al. | 162/197 |
| 3,171,579 | A | * | 3/1965 | Robertson | 26/75 |
| 3,719,975 | A | * | 3/1973 | Illarionov et al. | 26/51.3 |
| 4,017,227 | A | * | 4/1977 | Schmidt | 425/66 |
| 4,495,124 | A | * | 1/1985 | Van Erden et al. | 264/130 |
| 2003/0200636 | A1 | * | 10/2003 | Morman et al. | 28/170 |

FOREIGN PATENT DOCUMENTS

DE 100 23 169 A1 11/2001

* cited by examiner

*Primary Examiner*—Amy B. Vanatta
(74) *Attorney, Agent, or Firm*—McGlew and Tuttle, P.C.

(57) ABSTRACT

A web expanding device for or in a web-processing machine, especially a web-fed rotary printing press includes a frame and a cutting device (4) for longitudinally cutting a web (B) into a left-hand web strand (Bl) and a right-hand web strand (Br). A first deflecting device (5*l*) for the left-hand web strand (Bl) is provided along with a second left-hand deflecting device (6*l*) for the left-hand web strand (Bl), which is arranged after the first left-hand deflecting device (5*l*) in the direction of web delivery (F). A first right-hand deflecting device (5*r*) for the right-hand web strand (Br), which points toward the first left-hand deflecting device (5*l*) is provided along with a second right-hand deflecting device (6*r*) for the right-hand web strand (Br), which is arranged after the first right-hand deflecting device (5*r*) in the direction of web delivery (F) and points toward the second left-hand deflecting device (6*l*). The web strands (Bl, Br) can be expanded in parallel in relation to one another by an amount of expansion (X) by wrapping around the deflecting device (5*l*, 6*l*, 5*r*, 6*r*). At least one of the left-hand deflecting device (5*l*, 6*l*) and at least one of the right-hand deflecting device (5*r*, 6*r*) are mounted in the frame (2) adjustably by a path of adjustment each in order to adjust the amount of expansion (X). One of the second deflecting devices (6*l*, 6*r*) is movable in relation to the other of the second deflecting device (6*l*, 6*r*) and/or one of the first deflecting device is movable in relation to the other of the first deflecting device by a path of adjustment, so that the length of the path of the strand between the left-hand deflecting device (5*l*, 6*l*) differs from the length of the path of the strand between the right-hand deflecting device (5*r*, 6*r*).

14 Claims, 4 Drawing Sheets

WEB EXPANDING DEVICE

FIELD OF THE INVENTION

The present invention pertains to a web expanding device for a web-processing machine or in a web-processing machine, in which a material web to be processed, e.g., a plastic film or metal foil or especially a paper web is delivered endlessly and processed in the process. The processing machine may be especially a rotary printing press, preferably for printing large circulations of newspapers.

BACKGROUND OF THE INVENTION

DE 100 23 169 A1 describes a web expanding device with two arrow-shaped turning bars, which are arranged one after another behind a longitudinal cutting means in the direction of web delivery and are mounted movably in relation to one another in a machine frame. Due to the adjustment of the two arrow-shaped turning bars in relation to one another, two web strands of a web cut lengthwise can be offset in parallel to one another and expanded apart from each other as a result. The expanding device has a compact design. The two web strands are offset in parallel symmetrically in relation to the longitudinal cut, i.e., by the same amount of offset each.

SUMMARY OF THE INVENTION

The object of the present invention is to increase the flexibility of a web expanding device in terms of the possible guiding of the web.

The present invention pertains to a web expanding device, which is arranged in a web-processing machine or is intended to be arranged in a web-processing machine. It is used to create a distance between parallel web strands at right angles to a direction of web delivery or to preferably increase a distance that may already possibly be present. The web expanding device is inserted into the machine or is arranged in the machine preferably in front of a processing unit acting on the web, and in the case of a plurality of processing machines, it is preferably arranged in front of the processing unit that is the first processing unit when viewed in the direction of web delivery in order to set the position of the web strands in relation to the processing unit or the plurality of processing units at right angles to the direction of web delivery. The direction of web delivery is generally defined below as the longitudinal direction of the uncut web, and the longitudinal direction of the web strands offset in parallel is also designated by the same name.

The web expanding device comprises a frame, a cutting means for longitudinally cutting a web into a left-hand web strand and at least one additional, right-hand web strand, at least two left-hand deflecting means for the left-hand web strand and at least two right-hand deflecting means for the right-hand web strand. The deflecting means each point obliquely to the direction of web delivery. In the production, e.g., a print production, the left-hand deflecting means are wrapped around by the left-hand web strand and the right-hand deflecting means by the right-hand web strand, i.e., each of the deflecting means forms a deflection axis for the web strand with which it is associated. Each of the deflecting means may be formed especially in the manner of a turning bar. One of the deflecting means may also be formed by one rotatably mounted deflecting roller each, which is advantageous for the guiding of the web, but increases the complexity of the web expanding device.

The at least two left-hand deflecting means are arranged one after another in the direction of web delivery. They will therefore hereinafter be called the first upstream left-hand deflecting means and the second downstream left-hand deflecting means. They are preferably arranged in the path of the left-hand strand directly one after another, i.e., no additional deflecting means which would wrap around the left-hand web strand is located between them. What was said in connection with the left-hand deflecting means applies in the same manner concerning the right-hand web strand to the at least two right-hand deflecting means, which will hereinafter be called the first right-hand deflecting means and the second right-hand deflecting means. It should also be noted concerning the arrangement of the deflecting means that the first left-hand deflecting means and the first right-hand deflecting means point toward each other in a top view of the web, and the deflection axes formed by them form an angle of less than 180° in the top view. The second left-hand deflecting means and the second right-hand deflecting means also point toward each other in the top view, and the deflection axes of these deflecting means also form an angle of less than 180° in the top view. If the deflecting means or some of the deflecting means in the frame are mounted pivotably in the frame in order to pivot the deflecting means or some of the deflecting means for the purpose of an angular adjustment in the plane of the web or in the plane of the web strands, it is, however, also possible to conceive the case in which the deflecting means that are to point toward each other are aligned in one pivoted position, but no expansion will then be performed by the deflecting means in question.

The deflecting means are shaped and arranged in relation to one another such that the left-band web strand and the right-hand web strand are expanded apart from each other in parallel by the left-hand web strand wrapping around the left-hand deflecting means and by the right-hand web strand wrapping around the right-hand deflecting means. Expanding toward each other, i.e., a parallel offset in relation to one another, is alternatively conceivable, in principle. If the deflecting means have a corresponding pivotability, expanding apart from and toward each other would be possible as well. The web strands are offset in parallel in relation to their position before wrapping around the associated first deflecting means. The distance between the expanded web strands at right angles to the direction of web delivery will hereinafter be called the amount of expansion. To adjust the amount of expansion, at least one of the left-hand deflecting means is mounted movably in the frame by a path of adjustment in relation to the other left-hand deflecting means, and at least one of the right-hand deflecting means is mounted movably by a path of adjustment in the frame in relation to the other right-hand deflecting means. These at least two adjustment paths are preferably parallel to each other and, furthermore, preferably also equal. The parallelism of the offset can be guaranteed most simply by the left-hand deflecting means having the same cross-sectional shape among each other over their lengths acting on the left-hand web strand and also the right-hand deflecting means having the same cross-sectional shape and size among each other over their lengths acting on the right-hand web strand and, furthermore, by the deflection axes of the left-hand deflecting means and also the deflection axes of the right-hand deflecting means being parallel to each other in pairs in the adjusted positions.

According to the present invention, the first deflecting means or preferably the second deflecting means are movable relative to each other. In principle, both the first deflecting means can also be moved in relation to one another and the second deflecting means can also be moved in relation to one another. The movable deflecting means are preferably mounted such that the movable deflecting means can be moved along their path of adjustment independently from each other of the deflecting means. Due to the adjustability according to the present invention, the path lengths traveled by the web strands between the deflecting means associated with them can be varied in relation to one another, i.e., the path traveled by the left-hand web strand between the first left-hand deflecting means and the second left-hand deflecting means may be optionally greater or smaller than the path length traveled by the right-hand web strand between the first right-hand deflecting means and the second right-hand deflecting means. The deflecting means may, of course, also be adjusted to positions in which the path lengths of the two web strands between the respective associated deflecting means are equal.

The parallel offsets of the two web strands can therefore be selected to be different. One of the web strands may also pass over the web expanding device without parallel offset, while the other is offset in parallel. As a special advantage, the present invention offers the possibility of setting the parallel offset of one of the web strands independently from the other of the web strands.

The web expanding device according to the present invention can therefore form the final control element of a web edge control for at least one of the web strands and preferably for both web strands.

As far as the adjustability is concerned, each of the deflecting means may be mounted in the frame, e.g., in an individually movable manner. It is also conceivable, e.g., that the first left-hand deflecting means and the second right-hand deflecting means are mounted movably and the other two deflecting means are clamped in a fixed position in the frame. A possible adjustability for the purpose of compensating manufacturing tolerances shall be left out of consideration for the time being as far as the term of the fixed clamping is concerned. What is understood under adjustability in the present invention is that the deflecting means in question is still movable even while such an optionally performed adjustment is maintained. Furthermore, the movability is preferably such that the deflecting means in question can be moved into the desired adjusted position after the intake of a new web. It can especially preferably also be moved during the running production along its path of adjustment. Correspondingly, the expanding device comprises in the especially preferred embodiment a control means, which has a drive means for driving the movable deflecting means and can be advantageously expanded into a control or regulating means. However, the present invention also pertains, in principle, to a web expanding device in which the movable deflecting means are moved manually into the desired adjusted positions and are fixed in these adjusted positions.

The flexibility may be increased even further if the deflecting means and the longitudinal cutting means are movable together at right angles to the direction of web delivery in a linearly guided manner. The deflecting means and the longitudinal cutting means are preferably mounted together in the frame, and the frame as a whole is movable in relation to the processing unit or the plurality of processing units at right angles to the direction of web delivery, guided along a straight line.

Finally, it shall also be noted that it is not absolutely necessary to process a web cut lengthwise in the expanding device during the running production, but it may also happen that the web is already taken in with the width of a strand, because it had been already wound on a roll in the width of a strand.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
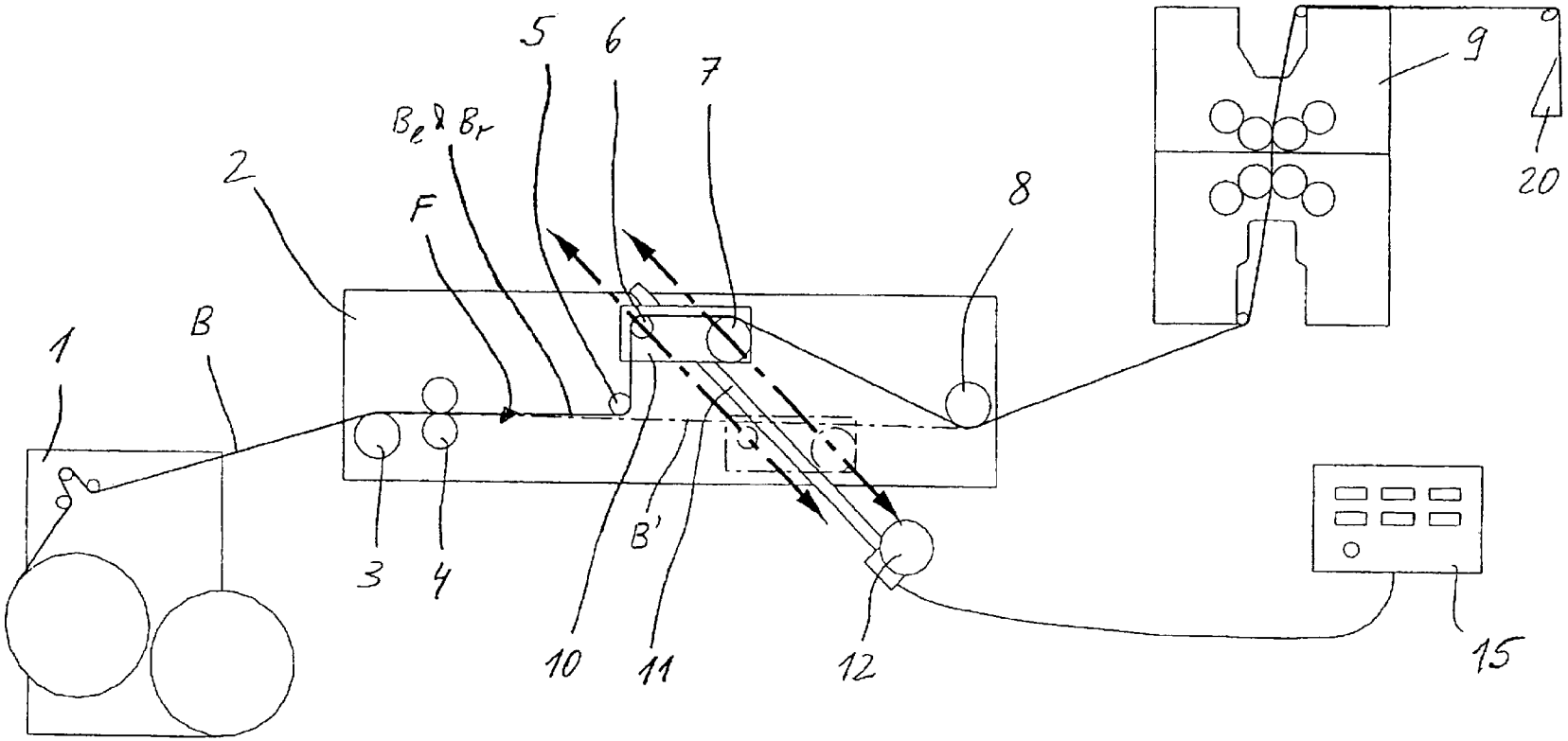
FIG. 1 is a schematic view showing a web expanding device in a web-fed rotary printing press.

Referring to the drawings in particular, FIG. 1 shows components of a web-fed rotary printing press, which comprises a web expanding device according to the present invention. The path of a web B to be printed on is shown from a roll changer 1 via a web expanding device to a printing unit 9, which is designed as a printing tower. A longitudinal cutting means 4, which is used to cut the web B lengthwise into two web strands Bl and Br, and the deflecting means 5 and 6, which are used to expand the web strands Bl and Br formed apart from each other in parallel. The expanded web strands Bl and Br are delivered in the direction of web delivery F to a printing tower 9 and are printed on there in multiple colors on both sides. Two cylinder bridges, each formed from two rubber blanket cylinders printing on the web strands Bl and Br, and an associated plate cylinder each, are shown as parts of the printing tower 9. The printing tower 9 may, of course, also comprise additional cylinder bridges of the same type to print, e.g., on both sides of the web strands Bl and Br in four colors. After the printing tower 9, the web strands Bl and Br are led to a former 20 either separately, each individually or with at least one other web strand, or they are led together to a common former 20, and folded lengthwise in the formers separately or they are folded lengthwise together in the former. After the former 20 or the plurality of formers, a folder may be arranged in the direction of web delivery F or a plurality of folders may be arranged for cross cutting and cross folding.

The uncut web B running into the expanding device from the roll changer 1 is delivered via an intake guide means 3 to the longitudinal cutting means 4. The longitudinal cutting means 4 is formed essentially by two cutting rollers, which can be adjusted toward and away from each other and between which the web B is delivered. The left-hand web strand Bl and the right-hand web strand Br are formed by the longitudinal cut. The web strands Bl and Br are led over a first deflecting means 5, a second deflecting means 6 following same immediately, and an outlet guide means 7. They are subsequently delivered to the printing tower 9 via additional guide means, of which a guide means 8 directly following the outlet guide means 7 is shown. The longitudinal cutting means 4 and the first deflecting means 5 are mounted in a frame 2 in fixed positions in relation to one another. The intake guide means 3 is a guide roller, which is mounted rotatably in the frame 2. The first deflecting means 5 is not rotatable.

The second deflecting means 6 is mounted rotatably in the frame 2 together with the outlet guide means 7 in a linearly guided manner. A linear guide path 11 of the mount is firmly connected to the frame 2. The second deflecting means 6 and the outlet guide means 7 are movable continuously to and fro between two extreme positions along the linear guide 11. One of the two extreme positions is shown in FIG. 1 by a solid line and the other by a broken line. A control means 15 controls a drive means 12 on the basis of preset values that can be entered in the control means 15 or a higher-level machine control, so that the second deflecting means 6 and the outlet guide means 7 assume the desired adjusted positions over the path of adjustment.

Figure 2:
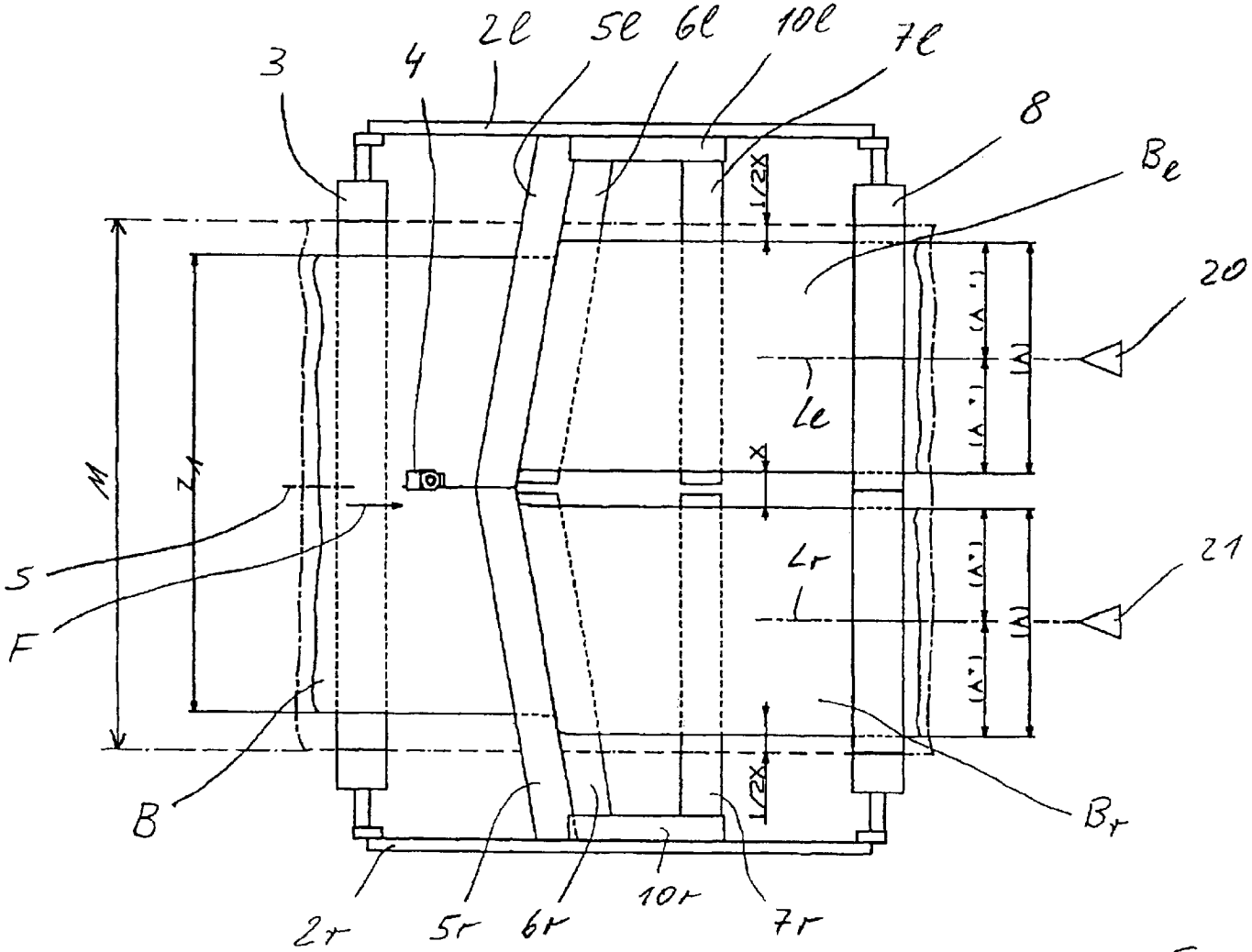
FIG. 2 is a top view showing the web expanding device in a state in which two strands of a web are expanded symmetrically apart from each other and are guided centrally to a former each.

FIG. 2 shows the web expanding device in a first state in a top view of the plane of the web. It can be recognized, in particular, that the second deflecting means 6 and the outlet guide means 8 are divided in the center into two symmetrical halves. The two halves are mounted rotatably, guided linearly independently from one another on a linear guide 11 each (FIG. 1), which is a rigid part of the frame. The paths of adjustment as well as the extreme positions of the two halves are the same. The movements of the two halves are controlled by the control means 15 via the drive means 12 and optionally also regulated. The two halves can thus be moved especially together or each individually or even in opposite directions along their paths of adjustment and fixed in any position between the extreme positions.

Due to the central division, a second left-hand deflecting means **6*l* and a second right-hand deflecting means 6*r* as well as a left-hand outlet guide means 7*l* and a right-hand outlet guide means 7*r* are formed. The second left-hand deflecting means 6*l* and the left-hand outlet guide means 7*l* are associated with the left-hand web strand Bl, i.e., they come into contact with the left-hand web strand Bl only. The second right-hand deflecting means 6*r* and the right-hand outlet guide means 7*r* are associated with the right-hand web strand Br, i.e., they come into contact with the right-hand web strand Br only. There is correspondingly an association in the case of the first deflecting means 5 as well. The first deflecting means 5 is, however, fastened in the frame on the two opposite sides 2*l* and 2*r* of the frame. The first deflecting means 5 is divided functionally into a first left-hand deflecting means 5*l* and a first right-hand deflecting means 5*r*. The deflecting means 5*l*, 5*r*, 6*l* and 6*r*** have the same cross section. They are designed as round bars in the exemplary embodiment.

In the top view of the plane of the arriving web B, the first deflecting means **5*l* and 5*r* and especially the deflection axes formed by them form an arrow shape, whose head points toward the direction of web delivery F. The first deflecting means 5*l* and 5*r* are firmly connected to one another in the middle in the area of the "arrowhead." The head itself is made round in order to avoid the risk of slightly slitting the web B. The longitudinal cutting means 4 and the head formed by the first deflecting means 5*l* and 5*r*** lie exactly on the machine axis S. The arrangement of the parts of the expanding device, which is associated with the left-hand web strand Bl, is symmetrical to the arrangement of the parts that are associated with the right-hand web strand Br. The machine axis S thus also forms at the same time a symmetry axis of the expanding device.

The left-hand deflecting means **5*l* and 6*l* form deflection axes that are parallel to each other for the left-hand web strand Bl. The right-hand deflecting means 5*r* and 6*r* form deflection axes that are parallel to each other for the right-hand web strand Br. The paths of adjustment of the second deflecting means 6*l* and 6*r* extend such that the parallelism of the deflection axes is preserved in each adjusted position of the second deflecting means 6*l* and 6*r***.

The outlet guide means **7*l* and 7*r* are arranged relative to the second deflecting means 6*l* and 6*r* such that the web strand plane defined by the second left-hand deflecting means 6*l* and the left-hand outlet guide means 7*l* in case of wraparound and the plane of the web strand plane defined by the second right-hand deflecting means 6*r* and the right-hand outlet guide means 7*r* in the case of wraparound are parallel to the web plane that is preset by the intake guide means 3 and the two first deflecting means 5*l* and 5*r* in the case of wrapping around these deflecting means. The outlet guide means 7*l* and 7*r* form deflection axes pointed at right angles to the direction of web delivery F. The second left-hand deflecting means 6*l* and the left-hand outlet guide means 7*l* are mounted together on a left-hand carriage 101. The mounting on the carriage 10*l* is such that the deflection axes of the second left-hand deflecting means 6*l* and of the left-hand outlet guide means 7*l* in relation to the carriage 10*l* are also adjustable, at any rate within the framework of tolerance-compensating adjustments. The same applies analogously to the mounting of the second right-hand deflecting means 6*r* and of the right-hand outlet guide means 7*r* on the right-hand carriage 10*r*. The two carriages 10*l* and 10*r* are movable along a separate linear guide 11 each on their respective frame sides 2*l* and 2*r*, the left-hand linear guide 11 pointing in parallel to the right-hand linear guide 11 and being arranged at the same level in relation to the direction of web delivery F. The two outlet guide means 6*l* and 6*r* may be mounted rotatably on the respective carriages 10*l* and 10*r*. The same also applies, in principle, to the second deflecting means 6*l* and 6*r***, but the design as a nonrotatable bar is preferred because of the simpler construction.

In the state of the expanding device shown in FIG. 2, the second left-hand deflecting means **6*l* and the second right-hand deflecting means 6*r* assume an adjusted position each in which they define a single plane that is plane-parallel to the arriving web B for the web strands Bl and Br. The second deflecting means 6*l* and 6*r* also form an arrow shape with one another in such positions, but with a narrow gap between their free ends, which exactly overlap each other in these positions. The deflection axes formed by the two deflecting means 6*l* and 6r intersect correspondingly. The deflection axes formed by the outlet guide means 7*l* and 7*r*** are aligned in these adjusted positions.

The web B runs into the expanding device symmetrically to the machine axis S. Due to this symmetry of the web and the positioning of the second deflecting means **6*l* and 6*r* in a common plane, the two web strands Bl and Br are expanded apart from one another to the outside in parallel by the same amount of offset away from the machine axis S on each side. The amount of expansion X is obtained, which designates the clearance between the web strands Bl and Br, which clearance is measured at right angles to the direction of web delivery F. The distance between a left-hand limiting line and a right-hand limiting line, which is measured in the web plane and up to which the web strands Bl and Br can be offset in parallel to the maximum extent on the outside to the left and on the outside to the right by means of the expanding device, assuming a sufficient web width, are designated by "M." In the state of the expanding device being shown with symmetrical intake of the web B, a distance of X/2 is left between the left-hand outer edge of the left-hand web strand Bl and the left-hand limiting line. Exactly the same distance is also left between the right-hand limiting line and the right-hand edge of the right-hand web strand Br. Due to the web width Z, the symmetrical intake, the symmetrical cutting and the symmetrical expansion to the amount of expansion X, the left-band web strand Bl runs centrally into the longitudinal former 20 associated with it, and the right-hand web strand Br likewise runs centrally into the longitudinal former 2***l* associated with it. The web strands Bl and Br are also printed symmetrically on both sides in relation to their longitudinal fold Ll and Lr. The widths of the web strands Bl and Br are designated by A, and the partial widths on both sides of the longitudinal folds Ll and Lr are designated by A'. Thus, Z=2A=4A'. It should be noted that the former 20 and the former 2*l* may be formed by a single former.

Figure 3:
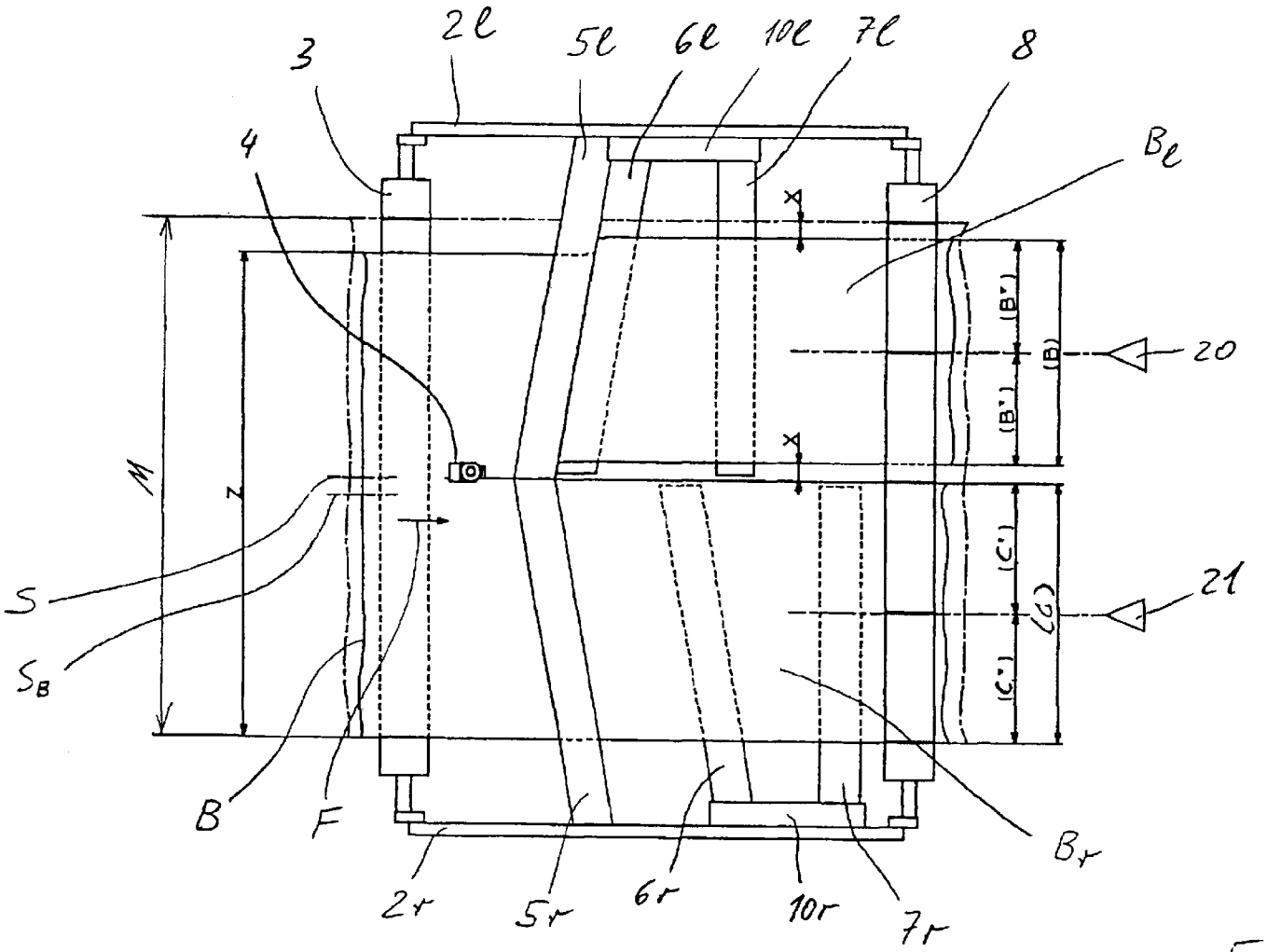
FIG. 3 is a top view showing the web expanding device in a state in which the strands of a web are expanded asymmetrically apart from each other and are fed centrally to a former each.

In the exemplary embodiment according to FIG. 3, the web B runs into the expanding device asymmetrically to the machine axis S. The longitudinal symmetry axis of the web B is designated by $S_B$. It is laterally offset in relation to the machine axis S. The web B is cut by means of the cutting means 4 asymmetrically into a left-hand web strand Bl and a right-hand web strand Br corresponding to the offset of the axes S and $S_B$.

In the second exemplary embodiment, the expanding device is in a state in which the right-hand carriage 10*r* with the second right-hand deflecting means 6*r* and with the right-hand outlet guide means 7*r* does not protrude into the path of the right-hand web strand Br and has consequently no wraparound contact with the right-hand web strand Br. The right-hand web strand Br is therefore delivered through the expanding device without lateral offset. The adjusted position of the second right-hand deflecting means 6*r* and of the right-hand outlet guide means 7*r* corresponds to the position indicated by broken line in FIG. 1. The second left-hand deflecting means 6*l* and the left-hand outlet guide means 7*l* are, however, moved into the path of the left-hand web strand Bl, e.g., into the other extreme position indicated by a solid line in FIG. 1. The roll changer 1 is set in the exemplary embodiment according to FIG. 3 such that the right-hand web strand Br is delivered on the right on the outside as much as possible. The right-hand outer edge of the web strand Br coincides with the right-hand limiting line of the web expanding device. The expanding device is arranged in relation to the formers 20 and 21 such that the web strands of a web B of the maximum width Z=M run centrally onto the formers 20 and 21 without parallel offset. In the exemplary embodiment according to FIG. 3, the right-hand web strand Br is delivered with its outer edge at the right-hand edge that is the outermost edge for it centrally to the associated longitudinal former 21. The left-hand web strand Bl, which is narrower by the double offset of the axes S and $S_B$, would be delivered to the longitudinal former 20 associated with it eccentrically if it also passed through the web expanding device unaffected. However, the second left-hand deflecting means 6*l* had been moved together with the left-hand outlet guide means 7*l* in relation to the first left-hand deflecting means 5*l* into such an adjusted position that it undergoes a parallel offset corresponding to the amount of expansion X, which offset has such a value that the left-hand web strand Bl is delivered centrally to the longitudinal former 20 associated with it.

It is assumed for the second exemplary embodiment that the web B has a width Z different from that of the web B in the first example shown in FIG. 2. The distance X of the outer edge of the left-hand web strand Bl from the left-hand limiting line corresponds to the amount of expansion X. The widths of the web strands Bl and Br are designated by B and C. On both sides of the fold lines Ll and Lr, the web strands Bl and Br have the same widths, which are designated by B' for the left-hand web strand Bl and by C' for the right-hand web strand Br, because of the central delivery to the longitudinal formers 20 and 21.

Figure 4:
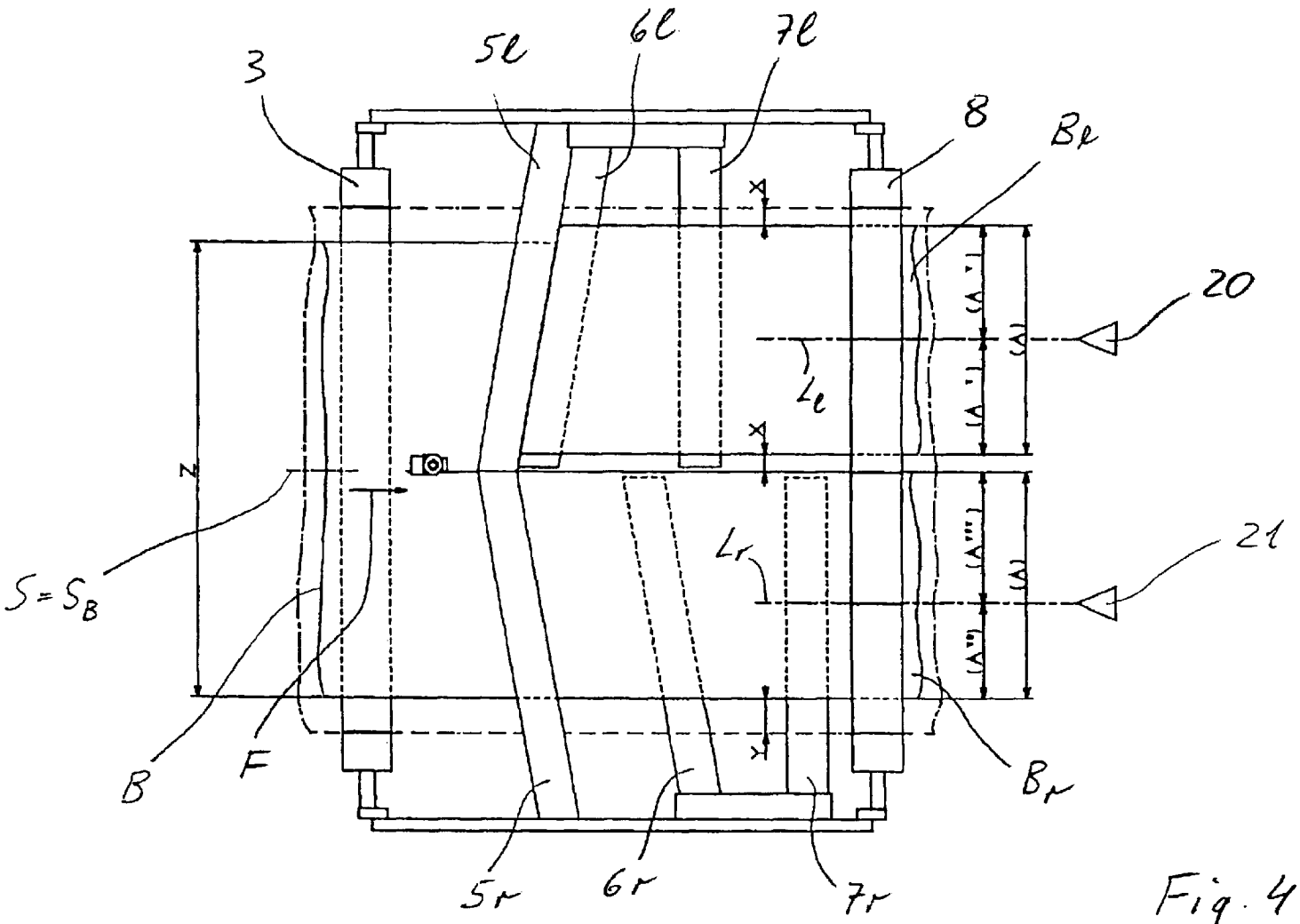
FIG. 4 is a top view showing the expanding device in a state in which the strands of a web are expanded asymmetrically apart from each other and one of the web strands is guided centrally and the other of the web strands is guided eccentrically to a former each.

In the third exemplary embodiment shown in FIG. 4, the web B is delivered from the roll changer 1 symmetrically to the machine axis S, i.e., the machine axis S coincides with the central longitudinal axis $S_B$ of the web. Since the longitudinal cutting is performed on the machine axis S, the two web strands Bl and Br formed have the same width A each, and it is assumed that the width Z of the web is the same as in the exemplary embodiment according to FIG. 2. The web expanding device is in the same state in the exemplary embodiment according to FIG. 4 as in the second exemplary embodiment. The right-hand web strand Br correspondingly passes through the web expanding device unaffected. However, unlike in the exemplary embodiment according to FIG. 3, the right-hand web strand Br has a distance Y from the outermost right-hand edge, so that the right-hand web strand Br would be folded longitudinally centrally, as is shown in the first exemplary embodiment according to FIG. 2, only if it were offset by the web expanding device in parallel to the right on the outside by the parallel offset Y/2 in relation to the machine axis S. The right-hand web strand Br is consequently delivered eccentrically to the longitudinal former 21 in the web strand guide of the third exemplary embodiment and is correspondingly folded lengthwise eccentrically. The print printed on it is correspondingly asymmetric. The partial width of the right-hand web strand Br on one side of the longitudinal fold line Lr is designated by A", and the width on the other side of the longitudinal fold line Lr, which is different from the former, is designated by A'". The second left-hand deflecting means 6*l* assumes such an adjusted position in relation to the first left-hand deflecting means 5*l* that the left-hand web strand Bl is delivered centrally to the longitudinal former 20. The parallel offset X of the left-hand web strand Bl corresponds to the amount of expansion. The partial widths on both sides of the longitudinal fold line Ll are equal in the left-hand web strand Bl and are correspondingly designated each by A'.

During the intake of a free leading end of a new web, the new web is led from the roll changer 1 over the inlet guide means 3 and between the cutting rollers of the cutting means 4, which have a gap between them. The leading end of the web is subsequently guided straight, i.e., without wrapping around the deflecting means 5*l* through 6*r* and the outlet guide means 7*l* and 7*r* and up to the additional outlet guide means 8 and is pulled in through the printing gap or the plurality of printing gaps of the printing tower 9 onto the formers 20 and 21, wrapping around the outlet guide means 8 and optionally also over additional guide means. As was mentioned above, the formers 20 and 21 may be a single former, onto which both web strands Bl and Br are brought together. The second deflecting means 6*l* and 6*r* and the outlet guide means 7*l* and 7*r* assume their lower end positions indicated by broken lines in FIG. 1. The web, which is still uncut when being pulled in, is likewise indicated by broken line and is designated by B'. After the web B' has reached the former or formers, it is cut lengthwise with the cutting means 4 into the web strands Bl and Br. The second deflecting means 6*l* and 6*r* or only one of the second deflecting means 61 and 6*r* and, together with them/it, the associated outlet guide means 7*l* or 7*r* of the outlet guide means 7*l* and 7*r* are moved into their adjusted positions and the desired amount of expansion X is thus set only when the web strands Bl and Br have passed through the outlet guide means 8 located closest to the outlet guide means 7*l* and 7*r* in the downstream direction of the web. Due to the displacing movement of the second deflecting means 6*l* and/or 6*r* and the outlet guide means 7*l* and/or 7*r*, which is continuous within the framework of the setting, the web strands Bl and Br are expanded continuously apart from one another in parallel until the amount of expansion X is set.

To reduce the friction, the deflecting means 5*l* through 6*r* have blowing air holes on their jacket surfaces, through which blowing air can be admitted to the wrapping-around web strands Bl and Br, as is known in connection with turning bars. The blowing air is switched on as soon as one of the deflecting means 5*l* through 6*r* is moved against the corresponding web strand Bl or Br. The blowing air is switched on, of course, in an automated manner, e.g., as a function of the adjusted position of the second deflecting means 6*l* and 6*r* and preferably under the control of the control means 15.

The path of adjustment of the second deflecting means 6*l* and 6*r* and of the outlet guide means 7*l* and 7r, which are predetermined by the shape of the two linear guides 11, extend obliquely linearly in relation to the plane of the web within an adjustment path plane each, which is at right angles to the web plane and points along the web. As was mentioned above, the two paths of adjustment are parallel to each other. Furthermore, the alignment of the paths of adjustment is such that the second deflecting means 6*l* and 6*r* and the outlet guide means 7*l* and 7*r* are moved opposite the direction of web delivery F to increase the amount of expansion X. In the extreme position of the maximum expansion, the web strands Bl and Br run between the first deflecting means 5*l* and 5*r* and the second deflecting means 6*l* and 6*r* at right angles to the web plane defined by the inlet guide means 3 and the first deflecting means 5*l* and 5*r*. As was mentioned above, the web strand plane defined by the second deflecting means 6*l* and 6*r* and the outlet guide means 7*l* and 7*r* is parallel to this web plane. The web plane between the inlet guide means 3 and the first deflecting means 5*l* and 5*r*, on the one hand, and the web strand plane between the second deflecting means 6*l* and 6*r* and the outlet guide means 7*l* and 7*r*, on the other hand, are parallel in all adjusted positions.

While a specific embodiment of the invention has been shown and described in detail to illustrate the application of the principles of the invention, it will be understood that the invention may be embodied otherwise without departing from such principles.

What is claimed is:

1. A web expanding device for or in a web-processing machine, the web expanding device comprising:

a frame;

a cutting means for longitudinally cutting a web into a left-hand web strand and a right-hand web strand;

a first deflecting means for deflecting said left-hand web strand;

a second left-hand deflecting means for deflecting said left-hand web strand, said second left-hand deflecting means being arranged after said first left-hand deflecting means in a direction of web delivery;

a first right-hand deflecting means for deflecting said right-hand web strand, said first right-hand deflecting means pointing toward said first left-hand deflecting means;

a second right-hand deflecting means for said right-hand web strand, said second right-hand deflecting means being arranged after said first right-hand deflecting means in a direction of web delivery and pointing toward said second left-hand deflecting means, said web strands being expanded in parallel in relation to one another by an amount of expansion by wrapping around said deflecting means, and at least one of said left-hand deflecting means and at least one of said right-hand deflecting means are movably mounted in said frame adjustably by a path of adjustment each in order to adjust said amount of expansion, and one of said second deflecting means is movable in relation to the other of said second deflecting means and/or one of said first deflecting means is movable in relation to the other of said first deflecting means by a path of adjustment, so that the length of the path of the strand between said left-hand deflecting means differs from the length of the path of the strand between said right-hand deflecting means.

2. A web expanding device in accordance with claim 1, wherein either said first deflecting means or said second deflecting means is firmly clamped in said frame.

3. A web expanding device in accordance with one of claim 1, wherein said movably mounted left-hand deflecting means and said movably mounted right-hand deflecting means are both a first deflecting means or both a second deflecting means.

4. A web expanding device in accordance with claim 1, wherein said movably mounted left-hand deflecting means and said movably mounted right-hand deflecting means can be moved on their path of adjustment into a plurality of adjusted positions into common web strand planes, in which they together form an arrow shape.

5. A web expanding device in accordance with claim 4, wherein said movably mounted left-hand deflecting means and said movably mounted right-hand deflecting means are movable together along their paths of adjustment while preserving the arrow shape.

6. A web expanding device in accordance with claim 1, further comprising: a control means and a drive means for said movable deflecting means to move said movable deflecting means into an adjusted position necessary for setting said amount of expansion and to fix said movable deflecting means in the adjusted positions.

7. A web expanding device in accordance with claim 1, further comprising a left-hand outlet guide means for said left-hand web strand and a right-hand outlet guide means for said right-hand web strand, each of said left-hand outlet guide means and said right-hand outlet guide means being mounted in said frame movable in relation to one another after said second deflecting means in a direction of web delivery and said outlet guide means and said second movably mounted deflecting means can be moved into adjusted positions, in which they together define a plane for said web strands.

8. A web expanding device in accordance with claim 7, wherein said left-hand outlet guide means and said second left-hand deflecting means are mounted such that they can move together, and said right-hand outlet guide means and said second right-hand deflecting means are also mounted in such a way that they can move together.

9. A web expanding device in accordance with claim 1, wherein said movably mounted deflecting means can be moved into adjusted positions, in which only said left-hand deflecting means is wrapped around by said left-hand web strand or only said right-hand deflecting means is wrapped around by said right-hand web strand in order to offset said web strands in parallel and to deliver the other of said web strands without offset through said expanding device.

10. A web expanding device in accordance with one claim 1, wherein said, movably mounted deflecting means are guided linearly over their paths of adjustment.

11. A web expanding device in accordance with claim 10, wherein said movably mounted deflecting means are guided linearly over their paths of adjustment on carriages traveling on a linear guide of said frame.

12. A web expanding device in accordance with claim 1, wherein said cutting means and said deflecting means are mounted movably together at right angles to the direction of web delivery in relation to said web.

13. A web expanding device in accordance with claim 1, wherein the web expanding device is used as a final control element of a web edge control of at least one of said web strands.

14. A web fed rotary printing press web expanding device of a web-processing machine, the web expanding device comprising:

a frame;

a cutter longitudinally cutting a web into a left-hand web strand and a right-hand web strand;

a first left hand deflector for deflecting said left-hand web strand;

a second left-hand deflector for deflecting said left-hand web strand, said second left-hand deflector being arranged after said first left-hand deflector in a direction of web delivery;

a first right-hand deflector for deflecting said right-hand web strand;

a second right-hand deflector for said right-hand web strand, said second right-hand deflector being arranged after said first right-hand deflector in a direction of web delivery, said web strands being expanded in parallel in relation to one another by an amount of expansion by wrapping around said deflectors and at least one of said left-hand deflector and at least one of said right-hand deflectors being mounted in said frame adjustably by a path of adjustment each in order to adjust said amount of expansion and one of said second deflector is movable in relation to the other of said second deflectors and/or one of said first deflector is movable in relation to the other of said first deflector by a path of adjustment, so that the length of the path of the strand between said left-hand deflectors differs from the length of the path of the strand between said right-hand deflectors.

* * * * *